United States Patent [19]

Schäfer et al.

[11] Patent Number: 4,788,760

[45] Date of Patent: Dec. 6, 1988

[54] INSTALLATION TOOL FOR LAYING CARPET (TRIM) STRIPS

[75] Inventors: Willi Schäfer, Feldafing; Günther Sepp, Ottobrunn, both of Fed. Rep. of Germany

[73] Assignee: Raumausstattung Willi Schafer, Tutzing, Fed. Rep. of Germany

[21] Appl. No.: 54,266

[22] Filed: May 26, 1987

[30] Foreign Application Priority Data

May 26, 1986 [DE] Fed. Rep. of Germany ..... 3617661

[51] Int. Cl.[4] ..... B25B 27/14

[52] U.S. Cl. ..... 29/278

[58] Field of Search ..... 254/200; 294/8.6; 29/235, 243.5, 278

[56] References Cited

U.S. PATENT DOCUMENTS

| | | | |
|---|---|---|---|
| 3,087,235 | 4/1963 | Porter | 29/278 |
| 4,529,238 | 7/1975 | Bell et al. | 294/8.6 |
| 4,549,334 | 10/1985 | Miller | 29/278 |
| 4,605,253 | 8/1986 | Anderson | 294/8.6 |

FOREIGN PATENT DOCUMENTS

| | | |
|---|---|---|
| 3429715 | 2/1986 | Fed. Rep. of Germany . |
| 3546264 | 7/1987 | Fed. Rep. of Germany . |

*Primary Examiner*—Frederick R. Schmidt
*Assistant Examiner*—Judy J. Hartman
*Attorney, Agent, or Firm*—Herbert Dubno

[57] ABSTRACT

The invention relates to an installation tool for the mounting of a carpet strip to serve as wall trim on an insertion-molding track. A short length of the carpet strip is first inserted by hand. The insertion tool is then placed on top of it. The insertion procedure is thereupon continued by simply sliding the installation tool.

10 Claims, 5 Drawing Sheets

INSTALLATION TOOL FOR LAYING CARPET (TRIM) STRIPS

CROSS REFERENCE TO RELATED APPLICATION

This application is related to our commonly owned copending application Ser. No. 07/007,735 filed Jan. 28, 1987.

FIELD OF THE INVENTION

The invention relates to an installation tool for mounting carpeting strips to serve as wall trim on insert molding track.

BACKGROUND OF THE INVENTION

In our German Offenlegungsschrift DE No. 3429715, a new type of insert mounting track is described, which serves to affix wall trim in the form of carpeting strips of the same material used for covering the floor.

In this process, the carpet strip is first glued firmly onto the lower part of the insert molding track so as to be flush with the floor. Then the carpet strip is folded backward and inserted behind the front lip of the approximately U-shaped insert molding track, which is open at the top. This procedure is successively applied in proceeding from one end of the wall to the other. The continual folding and insertion of the carpet strip by hand requires, firstly, a certain amount of time and, secondly, a certain degree of manual dexterity as well as strength and endurance on the part of the installer.

In our German document No. 3546264, therefore, a procedure and a device for performing this task are described, whereby use of an installation tool enables the carpet strip to be laid in a much simpler, more rapid and labor saving manner, even by untrained personnel.

The installation tool consists of two parts that can be fitted one upon the other, and which are placed successively in a certain manner onto a piece of molding strip inserted by hand, connected together, and then slid along laterally in such a manner as to fold over and insert the trim strip.

This installation tool and the procedure enabled by it has proved to be extremely labor saving. It nevertheless still exhibits a number of drawbacks.

The procedure described requires on the one hand a certain dexterity and experience with the insertion of the installation tool; on the other hand, its rear member displays a relatively complicated form, which makes manufacturing more difficult, and which is easily damaged by rough handling as well.

OBJECTS OF THE INVENTION

The object of the invention is to simplify the installation tool so that it is simpler to manufacture, more robust in handling and use, and significantly simplifies the procedure of mounting the the carpet strip on the insertion molding track.

SUMMARY OF THE INVENTION

This problem can be solved in a surprisingly effective, simple, and reliable manner by the invention.

According to the invention, the tool for layering carpeting strips to serve as wall trimming on a molding track, has a frontal part, the inner side of which has approximately the form which results from hand laying of the trimming in the transitional region between the fully inserted and the upright standing carpet strip. A metal capping sheet of the tool is bent away from the wall in its upper portion. The capping sheet terminates at its lower portion in a semicircular rounding of about 1½ carpet thickness in diameter, the lowermost reach of the rounding riding slightly above the lower limit dictated by the form of the insert molding track.

The end of the lower portion of the capping sheet facing in the travel direction of the tool can have a conical contraction directed inwardly.

The side opposite the travelling direction of the tool of the capping sheet is preferably shortened by a 45° cut starting at the bend.

The capping sheet can consist of thin, rugged, elastic sheet metal, e.g. stainless steel.

The capping sheet can be replaceably affixed by means of screws to the upper side of the front part of the installation tool.

The capping sheet is coated along its lower member which glides along the wall with a scratch-proof slick coating such as silicon nitride or Teflon.

The front part of the installation tool is manufactured by casting in metal or plastic, whereby for the sake of material economy the outer face of the tool has hollows separated by one or more struts for stability.

The outer face of the front part of the installation tool has a handle, which can be unscrewed from the supporting threads and secured in one of the hollows of the installation tool by means of the spring clip.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
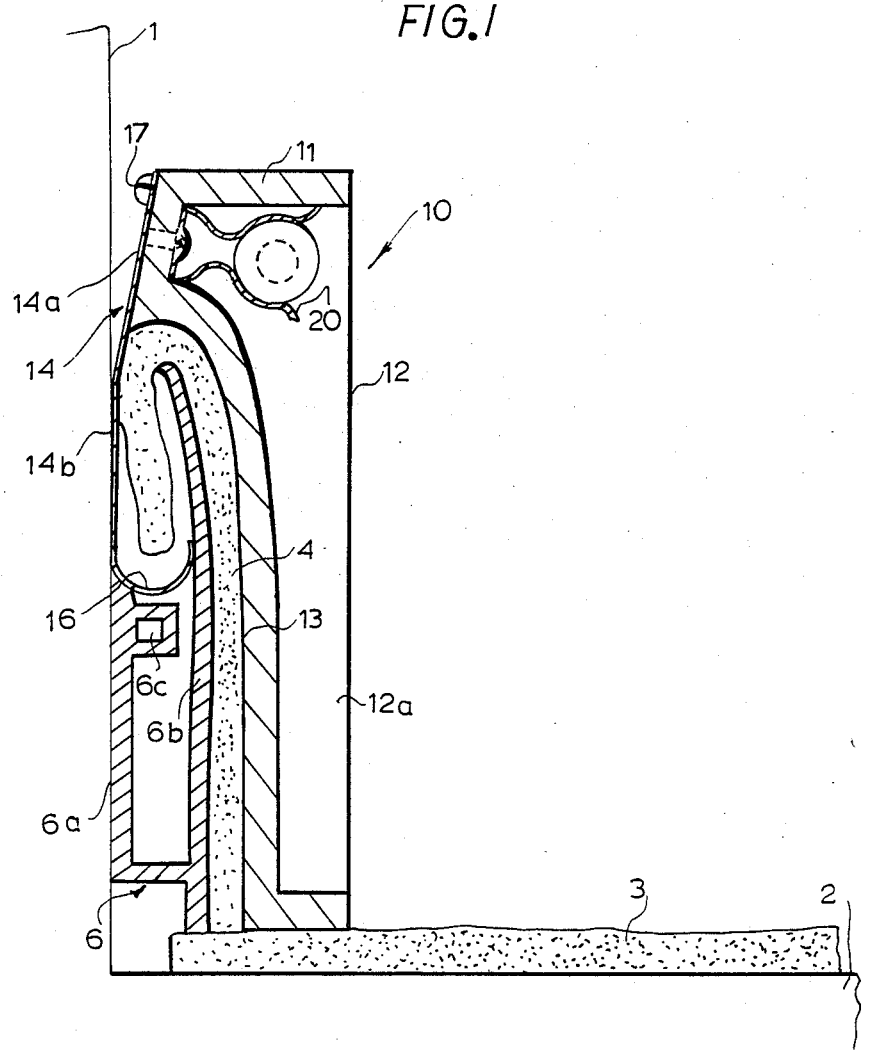
FIG. 1 is a cross section at the end of the installation tool along with the insertion molding strip and fully inserted carpeting strip.
Figure 2:
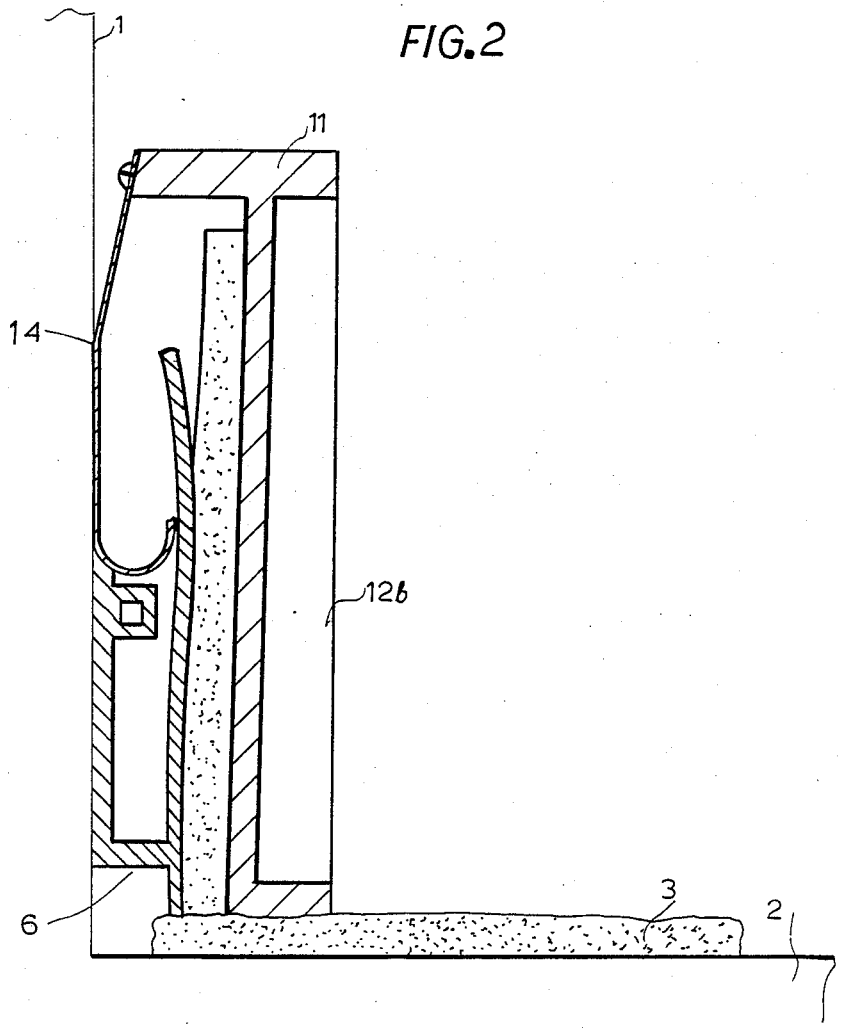
FIG. 2 is a cross section at the other end of the installation tool with the insertion molding track and carpet strip glued onto the molding track but not yet folded over.
Figure 3:
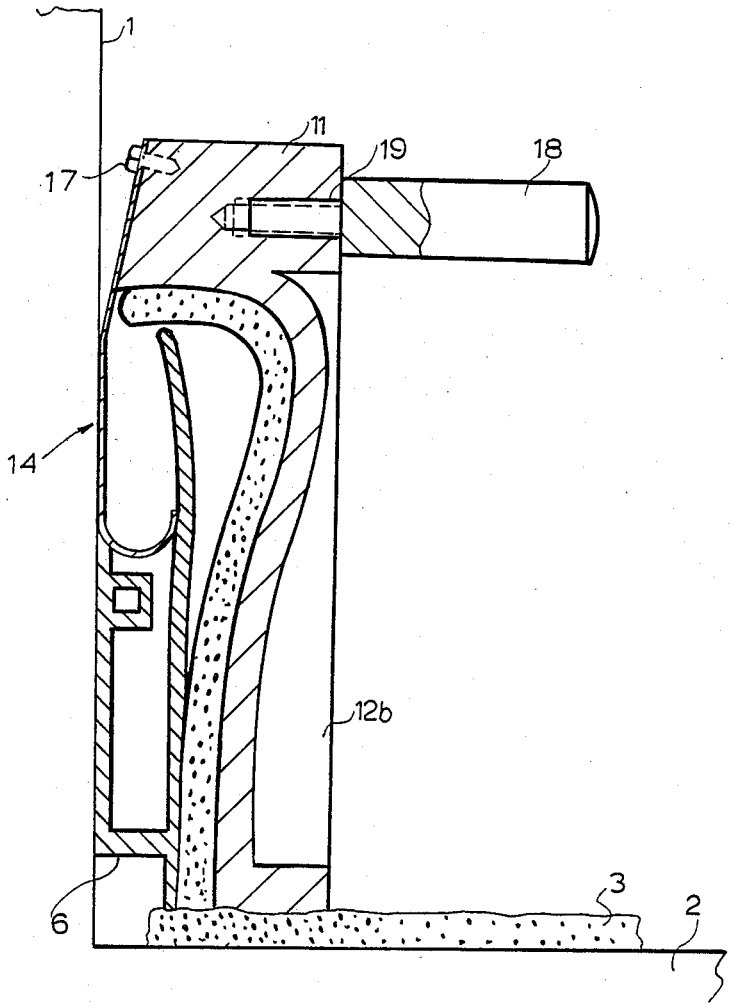
FIG. 3 is a cross section of the installation tool and the insertion molding track with partially inserted carpet strip, i.e. at a position between those of FIG. 1 and FIG. 2, with handle screwed onto the tool.
Figure 4:
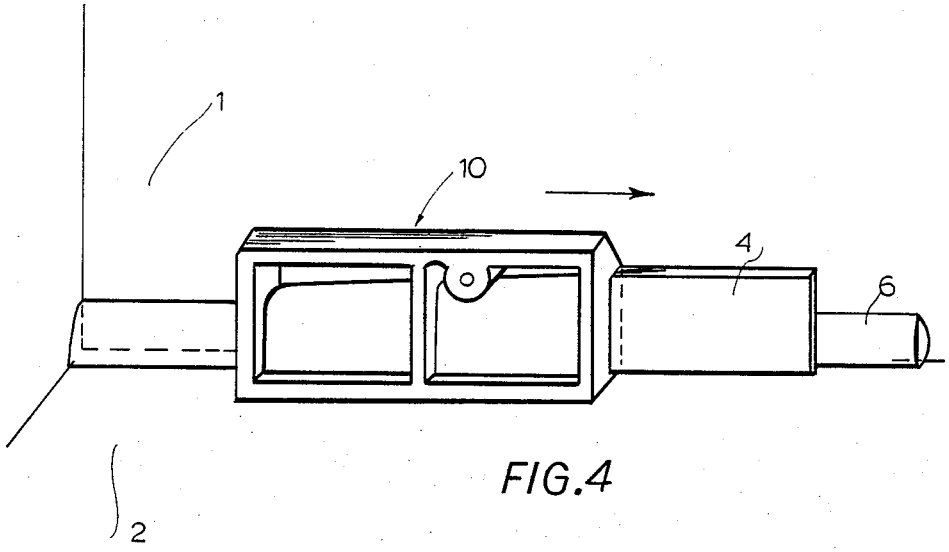
FIG. 4 is a perspective view toward the wall with installation tool and partially inserted carpet strip, with the direction of travel of the tool indicated by an arrow.
Figure 5:
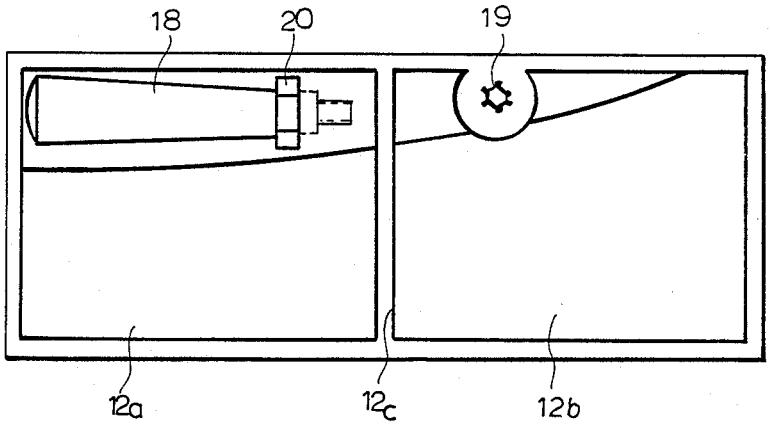
FIG. 5 is a view in the direction of the wall of the installation tool with handle unscrewed and inserted in a clip.

The analysis presented in patent German document No. 3546264 of the fold-over and insertion procedure of the carpet strip into the insertion moulding track during sliding of the installation tool revealed the following:

1. First a curvature or convexity in the direction of the interior of the room must be induced at about half the height of the insertion molding track in the carpet strip, which initially stands in an approximately upright position. This was achieved there by means of a segment.

2. The beginning of the process of folding over toward the wall is initiated by the cooperative action of the segment in conjunction with the inner side of the frontal part of the installation tool.

3. The frontal lip of the insertion molding track must be pushed away from the rear lip so that the hollow space between the two lips is enlarged. This is accomplished by means of a further segment.

A continuation of this analysis, which in particular investigates in greater detail the functioning of these segments in addition to that of the metal capping sheet used there as well, permits an essential simplification of the installation tool as well as of the procedure connected with its employment. The first essential point to be realized is that a bulge in the carpet strip 4 pointing into the interior of the room is an inescapable consequence of the combined action of the inner side of the frontal member of the installation tool with the capping sheet. Thus the segment, which is complicated in form and terminates in a thin end which is difficult to manufacture and easily damaged, can be dispensed with entirely.

Furthermore, the segment, having a variable cross section which is thicker in the middle, can be constructed with a constant cross section without a deleterious effect to its functioning, namely that of forcing apart the two lips and of the insertion mounting track. If the end regions of segment are thickened so that they have the same cross section as in the middle region—i.e. the region of maximal lip separation—then the carpet strip will merely be temporarily compressed slightly more on sliding past these parts without the occurrence of any effect detrimental to the end result of the installation. It can, furthermore, be of advantage, especially when laying specially resilient carpeting material, to compensate for this additional spreading at the ends of a segment with constant cross section by altering the inner side of the frontal part of the installation tool correspondingly.

A further result of this closer analysis is that even the massive form of segment is disadvantageous, since it reduces the space available for accepting the folded-over carpet strip. The carpet strip may therefore not be as broad as would be the case on insertion by hand. This cannot only be detrimental to the firm clamping of the carpeting strip, but also requires a narrower tolerance when cutting the strip.

Finally, the connection of the segment with the thin capping sheet in the above mentioned patent document requires a certain amount of technical means. The final result of the analysis is thus that simplification of the segment and the capping sheet is required.

According to the invention, the lower portion of the breadth **14*b* of the capping sheet 14 terminates in an approximately semicircular rounding 16 of approximately 1½ carpet thicknesses in diameter, the lower extremity of which rides slightly above the lower limit dictated by the form of the insertion moulding strip 6. The front lip 6*b* is thereby forced away from the rear lip 6*a* so that the carpet strip 4 can easily slide into place between the two lips 6*a* and 6*b* practically up to the so called nail chamber 6*c* of the insertion molding strip 6**.

Figure 6:
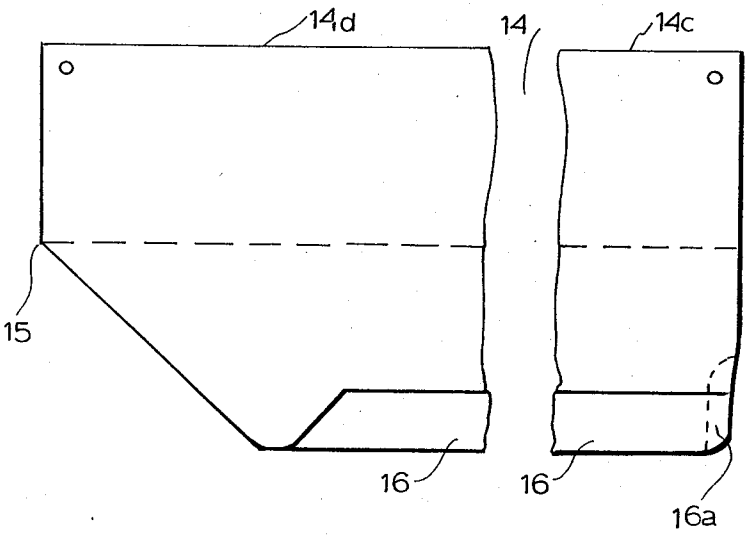
FIGS. 6A and 6B are respectively a front view and cross section of the metal capping sheet.
Figure 6A:
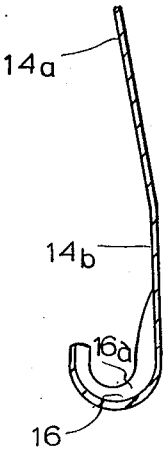

In order to avoid the above mentioned alteration of the inner side 13 of the insertion tool 10, the capping sheet 14 is shortened in its rear extremity with respect to the travel direction of the tool by means of a 45° cut running forward from the bend 15 (see FIGS. 6A and 6B). In this part, the carpet strip 4 has already been inserted so that further lip separation is no longer necessary—in fact superfluous, if not detrimental. On account of the absence of this rear portion of the rounding 16 responsible for the forced separation, the insertion moulding track 6 and the carpet strip 4 already have their final form upon emerging from the installation tool 10.

The capping sheet 14 is preferably to be constructed of thin, rugged, elastic sheet metal, e.g. stainless steel, and coated along its lower part **14*b*, which glides along the wall 1, with a scratchproof slick layer such as silicon nitride or teflon. As possibly subject to wear, it is replaceable, being fastened at the upper side of the frontal part 11 of the installation tool 10 by means of screws 17. To insure unhindered sliding of the installation tool 10 even past those places where two separate lengths of insertion moulding track 6 have been joined together with imperfect flush, the capping strip 14 is provided with an inward conical flare or bevelling 16*a*, at the end 14*c* pointing in the direction of travel of the tool, by means of which even the lip 6*b* of a non flushly jointed length of installation molding track 6 will be engaged by the sliding installation tool 10** and forced outward from the inner lip.

The emplacement of the installation tool according to the above mentioned patent document was relatively involved. For this purpose, the rear part of the installation tool was first placed over the front lip of the insertion moulding strip and slid toward the corner of the room until a small portion of the carpet strip inserted by hand was dislodged from the insertion moulding track. Then the frontal member of the installation tool was placed upon the rear member, which was partially covered by the carpet strip. In doing so, it was necessary to attend carefully to the correct coupling of the connecting elements necessary for a force-effective coupling of the two members of the installation tool.

When using an installation tool 10 as described in this invention, the emplacement is entirely bereft of difficulty. It is placed over the inserted portion of the carpet strip 4 as a single apparatus, complete with the rounding 16 of the capping sheet 14, and pressed downwards. The rounding 16 thereby forces without difficulty the lip **6*b* with carpet strip 4 away from the wall 1 so that the installation tool 10** slides by itself into its correct working position without the need for any exact positioning or sliding back and forth, and with no need to attend to the correct fitting together of two members during emplacement.

The frontal part 11 of the installation tool 10 is preferably to be manufactured by casting in a metal such as aluminum or in plastic, whereby for the sake of material economy, hollows **12*a*, 12*b* may be left in the outer side 12 with one or more struts 12*c* for support. It is provided with a handle 18, which can be unscrewed from the threaded mount 19 and secured in the hollow 12*a* by means of a spring clip. In this condition, the installation tool 10** can be easily packed and transported. By means of the measures described, an installation tool is thus created which, compared with those of the current state of the art, is simpler to manufacture, more robust in handling and use, and which simplifies considerably the insertion procedure of carpeting strip into the insertion molding track.

We claim:

1. A tool for the installation of a wall trimming which comprises a molding track extending along a wall and formed with an outer lip spaced from said wall and deflectable to allow a carpeting strip fastened to an outer face of said molding to be folded over said lip, said molding further having a structure limiting depth of insertion between said wall and said lip, said tool comprising:

an elongated folding member slidable along said track and contoured to have a surface which engages said carpeting strip an progressively folds said strip over said lip and into a gap between said lip and said wall as said folding member is moved in a given direction along said track, and a flank inclined upwardly away from said wall above said surface and confronting said wall; and a capping sheet fastened to said member, extending substantially the length of said member, and formed with an upper portion bent at an angle to an intermediate portion reaching downwardly between said lip and said wall and extending over its breadth away from said wall, said upper portion being affixed to said flank, said capping sheet being provided with a lower portion formed on the bottom of said intermediate portion and shaped as a semicylindrical rounding with a diameter of about one and one-half times the thickness of said strip, riding slightly above said structure and pressing said lip away from said wall to enable insertion of said strip between said lip and said wall by said surface.

2. The tool defined in claim 1 wherein an end of said lower portion of said capping sheet furthermost in said direction being provided with an inwardly directed conical construction enabling said sheet to engage said strip without damaging same.

3. The tool defined in claim 1 wherein said intermediate portion and said lower portion of said sheet are cut away at a 45° angle beginning at said upper portion at the end of said sheet furthermost in a direction opposite said given direction.

4. The tool defined in claim 1 wherein said capping sheet is composed of an elastic sheet metal.

5. The tool defined in claim 4 wherein said sheet metal is stainless steel.

6. The tool defined in claim 1 wherein said capping sheet replaceably affixed by screws transversing said upper portion clings to the top of said flank.

7. The tool defined in claim 1 further comprising a coating of a scratch-proof slick material on said intermediate portion and in engagement with said wall.

8. The tool defined in claim 7 wherein said coating is selected from the group which consists of silicon nitride and Teflon.

9. The tool defined in claim 1 wherein said member is cast with hollows separated by struts providing structural stability for said member.

10. The tool defined in claim 1 further comprising a handle threadedly attachable to said member and a spring clip on said member for receiving said handle upon threaded detachment thereof from said member.

* * * * *